US007306840B2

(12) United States Patent
Brade-Scholz et al.

(10) Patent No.: US 7,306,840 B2
(45) Date of Patent: Dec. 11, 2007

(54) FLAT NEEDLE-PUNCHED NON WOVEN OF NATURAL AND/OR SYNTHETIC FIBERS

(75) Inventors: Gabrielle Brade-Scholz, Kempen (DE); Martin Mangold, Neckargemünd (DE); Dieter Meiser, Albstadt (DE)

(73) Assignee: HP-Chemie Pelzer Research & Development Ltd., Waterford (IE)

( * ) Notice: Subject to any disclaimer, the term of this patent is extended or adjusted under 35 U.S.C. 154(b) by 285 days.

(21) Appl. No.: 10/484,019

(22) PCT Filed: Jul. 12, 2002

(86) PCT No.: PCT/EP02/07773

§ 371 (c)(1),
(2), (4) Date: Apr. 15, 2005

(87) PCT Pub. No.: WO03/021032

PCT Pub. Date: Mar. 13, 2003

(65) Prior Publication Data

US 2006/0105151 A1 May 18, 2006

(30) Foreign Application Priority Data

Jul. 18, 2001 (DE) ..... 101 34 934

(51) Int. Cl.
*B32B 27/14* (2006.01)
*B32B 3/00* (2006.01)

(52) U.S. Cl. ..... 428/195.1; 428/141; 428/156; 428/171; 428/196; 428/219; 442/101; 442/148; 442/152; 442/164; 442/402

(58) Field of Classification Search ..... 442/402, 442/101, 148, 152, 164; 428/96, 141, 171, 428/195.1, 196, 219
See application file for complete search history.

(56) References Cited

U.S. PATENT DOCUMENTS

| | | | | |
|---|---|---|---|---|
| 2,669,527 | A * | 2/1954 | Horwich | 428/167 |
| 3,937,861 | A * | 2/1976 | Zuckerman et al. | 442/148 |
| 4,258,097 | A * | 3/1981 | Benedyk | 428/219 |
| 4,504,537 | A * | 3/1985 | Mussallem, Jr. | 428/167 |
| 6,200,662 | B1 * | 3/2001 | Mussallem, III | 428/95 |

FOREIGN PATENT DOCUMENTS

| | | |
|---|---|---|
| DE | 24 19 813 A1 | 11/1975 |
| DE | 86 10 035.1 U1 | 9/1986 |
| DE | 41 14 140 A1 | 11/1992 |
| DE | 43 05 428 C1 | 7/1994 |
| DE | 44 44 030 A1 | 10/1995 |
| DE | 197 20 365 C2 | 12/1998 |
| DE | 198 12 925 A1 | 9/1999 |

OTHER PUBLICATIONS

International Search Report for PCT/EP02/07773; ISA/EPO; Mailed: Dec. 20, 2002.

* cited by examiner

*Primary Examiner*—Norca L. Torres Velazquez
(74) *Attorney, Agent, or Firm*—Harness, Dickey & Pierce, PLC

(57) ABSTRACT

The invention relates to a flat needle-punched non woven of natural and/or synthetic fibers having a weight per unit area within a range of from 200 to 1600 g/m$^2$, characterized in that one tenth to one hundredth of at least one of the two main surfaces has a surface coating in the form of a pattern.

13 Claims, No Drawings

FLAT NEEDLE-PUNCHED NON WOVEN OF NATURAL AND/OR SYNTHETIC FIBERS

The invention relates to a flat needle-punched non woven of natural and/or synthetic fibers.

DE 41 14 140 A1 relates to textile sheets in which the bonding of the fibers is effected through thermoplastic polyamides. An advantage of the textile sheets is their suitability for being reutilized after use. In addition, advantages previously made up with in the preparation of the textile sheets, offensive smells and undesirable decomposition products are excluded.

DE 43 05 428 C1 describes a floor covering formed from a flat fleece which has burls like islands integrally with the underside which burls consist of a multiplicity of individual fibers. On its upper side, the floor covering preferably has a structure. The structures of both sides are formed by needling. When the floor covering is laid, the burls come to lie on the underfloor covering. This forms a channel system on the underside of the floor covering which favors the drainage of water. A thus designed floor covering is preferably employed outdoors, for example, as a tennis court covering, wherein granules can be introduced into the indentations on the upper side.

DE 44 44 030 A1 describes a floor covering, especially for tennis courts. It consists of a carpet-like base covering and a non-slip scattering provided on top thereof and consisting of separate loose particles. The particles of the non-slip scattering are respectively extruded from a plastic material with an essentially defined cross-sectional shape and length, wherein the length is respectively at least approximately equal to a particle width or height running about midway through the cross-section.

DE 198 12 925 A1 describes three-dimensional, dimensionally stable molded parts based on structured needle-punched non wovens. The needle-punched non wovens of thermoplastic fibers with a first layer of a mixture of polypropylene (PP) fibers and polyethylene (PE) fibers and a second and optionally further layers of a mixture of PP fibers and PE fibers is prepared from bicomponent fibers consisting of a mixture of PP and PE, or from a mixture of these bicomponent fibers and PP fibers and/or PE fibers, wherein the two layers are bonded and interconnected by both needle-punching and molten or fused fibers or fiber portions of the PE fraction of the two layers.

In contrast, the object of the present invention is to provide a novel flat needle-punched non woven of natural and/or synthetic fibers having a pronounced non-slip effect on the upper side of the needle-punched non woven.

In a first embodiment, the above mentioned object is achieved by a flat needle-punched non woven of natural and/or synthetic fibers having a weight per unit area within a range of from 200 to 1600 g/m$^2$, characterized in that one tenth to one hundredth of at least one of the two main surfaces has a surface coating in the form of a pattern.

The needle-punched non wovens according to the invention are much less expensive than previously known textile sheets, i.e., usual carpets. This not only holds for means of transport, but also for real estate objects and free spaces, such as sports grounds. Especially when inexpensive fibers are used, it is possible by means of the present invention to prepare a particularly inexpensive covering.

High needle-punched non wovens (dilours) are not suitable for the present invention because they fail to sufficiently achieve an insufficient bonding of the surface coating in the form of a pattern.

In a particular embodiment of the present invention, the base material of the non woven comprises polypropylene (PP), polyethylene (PE), polyethylene terephthalate (PET) and/or polyamide (PA), essentially in a fibrous form. Alternatively, it is of course also possible to employ vegetable fibers instead of the synthetic fibers.

Of course, optionally, mixtures of natural fibers and synthetic fibers may also be employed.

Natural fibers within the meaning of the present invention are generally defined as natural one-dimensional objects which can be processed into a textile. They may be obtained from vegetable parts, or form the coat of hair of animals, or be obtained from cocoons of silkworms, or be of mineral natural origin. The vegetable fibers may be seed fibers, for example, cotton, fruit wall fibers, for example, kapok, bast fibers, for example, flax, hemp and/or jute etc., or hard fibers, for example, sisal, coconut or the like.

It is particularly preferred according to the present invention for the weight per unit area of the flat needle-punched non wovens according to the invention to be from 200 to 1000 g/m$^2$. In this case too, this is the total weight of the needle-punched non woven plus the surface coating.

In a preferred embodiment of the present invention, only one tenth to one fiftieth of at least one of the two main surfaces has a surface coating in the form of a pattern. Similarly, it is of course also possible to provide, not only one, but both main surfaces of the needle-punched non woven with the desired surface coating.

The pattern of the surface coating can be geometrically distributed over one or both main surfaces. Alternatively, it is of course also possible to limit the pattern to only partial areas of the main surfaces.

Preferred patterns within the meaning of the present invention include burls, circles, lines and/or figures. Thus, it is possible, for example, to apply graphic ornaments, such as logos, to a needle-punched non woven.

An essential core of the present invention is the feature that the surface coating protrudes above the main surface of the needle-punched non woven. It is particularly preferred according to the present invention for the surface coating to protrude above the main surface by 0.1 to 1 mm, especially by 0.1 to 0.5 mm.

In a preferred embodiment, it is essential according to the present invention that the surface coating extends to a depth of from 0.1 to 0.5 mm, especially from 0.1 to 0.3 mm, of the main surface of the needle-punched non woven.

The material of the surface coating can be selected from a wide variety of categories. It is particularly preferred according to the present invention to select thermoplastic or thermosetting materials. As a thermoplastic material, there may be used, for example, polypropylene (PP), polyethylene (PE), polyurethane (PUR), polyethylene terephthalate (PET), polyamide (PA), and/or polyvinyl chloride (PVC). As a thermosetting material according to the present invention, polyurethane is particularly preferred. The non-slip effect can be improved, for example, by mineral additives. It is also possible to apply an electrical conduction finishing to the surface coating, which is suitable for an antistatic effect (computer rooms) or alarm device.

The preparation of the needle-punched non woven according to the invention is characterized, for example, in that a surface coating is applied to or sprayed onto a flat needle-punched non woven in the form of a pattern using a roll according to per se known printing methods. The surface coating in the form of a pattern can be applied prior to or after the densification of the needle-punched non woven. It is particularly preferred according to the present invention to apply the surface coating prior to a predensification of the needle-punched non woven. If this is performed prior to a predensification of the needle-punched non woven, the penetrating depth of the surface coating into the needle-punched non woven is low.

In addition, it is also possible to introduce, for example, to pour, the surface coating into prestamped indentations of the needle-punched non woven. Thus, optically planar needle-punched non wovens can be prepared which display their non-slip effect only when under the load of a pressure.

It is particularly preferred according to the present invention to employ the needle-punched non wovens as a floor covering, for example, in means of transport, especially motor vehicles, aircrafts, vessels and railway wagons, and as a trunk lining in motor vehicles or real estate objects, especially as a covering for sports grounds, for example, tennis courts.

The invention claimed is:

1. A flat needle-punched non woven of natural and/or synthetic fibers having a weight per unit area within a range of from 200 to 1600 g/m$^2$, said needle-punched non-woven including first and second main surfaces, characterized in that at least one of the two main surfaces has a surface coating in the form of a pattern, wherein said pattern comprises burls, circles, lines and/or figures, and wherein said surface coating protrudes above the main surface by an average of 0.1 to 1 mm, said surface coating extends to an average depth of from 0.1 to 0.5 mm of the main surface and said surface coating covers from one tenth to one hundredth of at least one of the two main surfaces.

2. The needle-punched non woven according to claim 1, characterized in that the synthetic fibers are selected from the group consisting of polypropylene, polyethylene, polyethylene terephthalate, polyamide, and combinations thereof.

3. The needle-punched non woven according to claim 1, characterized in that the natural fibers are vegetable fibers.

4. The needle-punched non woven according to claim 3, characterized in that said vegetable fibers are selected from seed fibers, fruit wall fibers, bast fibers, hemp, jute, hard fibers, coconut, or combinations thereof.

5. The needle-punched non woven according to claim 1, characterized in that said weight per unit area is from 200 to 1000 g/m$^2$.

6. The needle-punched non woven claim 1, characterized in that one tenth to one fiftieth of at least one of the two main surfaces has a surface coating in the form of a pattern.

7. The needle-punched non woven according claim 1, characterized in that said pattern of the surface coating is geometrically distributed over at least a portion of a whole main surface.

8. The needle-punched non woven according to claim 7, characterized in that said surface coating protrudes above the main surface by 0.1 to 0.5 mm.

9. The needle-punched non woven according to claim 8, characterized in that said surface coating extends to a depth of from 0.1 to 0.3 mm of the main surface.

10. The needle-punched non woven according to claim 1, characterized in that the material of said surface coating comprises thermoplastic or thermosetting materials.

11. The needle-punched non woven according to claim 10, characterized in that said thermoplastic material is selected from the group consisting of polypropylene, polyethylene, polyurethane, polyethylene terephthalate, polyamide, polyvinyl chloride or combinations thereof.

12. The needle-punched non woven according to claim 10, characterized in that said thermosetting material comprises polyurethane.

13. A method for the preparation of the needle-punched non woven according to claim 1, characterized in that a surface coating is applied to a flat needle-punched non woven in the form of a pattern using a roll, spray or combination thereof.

* * * * *